United States Patent [19]

Pelousse

[11] 4,217,828

[45] Aug. 19, 1980

[54] SAFETY DEVICE FOR FUSES

[75] Inventor: Jean A. Pelousse, Brussels, Belgium

[73] Assignee: S.A. PRB, Société Anonyme, Brussels, Belgium

[21] Appl. No.: 940,756

[22] Filed: Sep. 8, 1978

[30] Foreign Application Priority Data

Sep. 9, 1977 [BE] Belgium ..... 256225

[51] Int. Cl.[2] ..... F42C 15/24

[52] U.S. Cl. ..... 102/249; 102/253

[58] Field of Search ..... 102/249, 251, 253, 255, 102/233

[56] References Cited

U.S. PATENT DOCUMENTS

| | | | |
|---|---|---|---|
| 2,446,745 | 8/1948 | Delay | 102/233 |
| 3,286,634 | 11/1966 | Weber | 102/249 |
| 3,715,987 | 2/1973 | Morel et al. | 102/253 X |
| 3,814,018 | 6/1974 | Daniel | 102/253 |
| 4,128,061 | 12/1978 | Kaiser | 102/249 |

FOREIGN PATENT DOCUMENTS

| | | | |
|---|---|---|---|
| 1477420 | 6/1964 | France | 102/249 |
| 127622 | 6/1919 | United Kingdom | 102/253 |

*Primary Examiner*—David H. Brown

*Attorney, Agent, or Firm*—Bacon & Thomas

[57] ABSTRACT

Safety device for fuses, of the type which comprises a mobile element, which can be moved from a position of safety in which aforesaid mobile element may either be part of the pyrotechnical chain, of an electric or of an electronic circuit, or contain any one of such elements, or be solid or hollow in order to obstruct or permit the passage of an element of the fuse towards its active position, characterized by the combining of a tubular bolt, assuring the locking of aforesaid mobile element; of a sheath which at least partially surrounds aforesaid bolt, of balls entered in radial passages provided in aforesaid sheath; of a collar which can move axially by the effect of inertia so as to free aforesaid passages and permit the expulsion of aforesaid balls; and of an elastic means which stresses aforesaid collar towards the closing position of aforesaid passages.

4 Claims, 6 Drawing Figures

13
15
14
11
16
22
17
23
19
5
4
9
8
10
6
2
7
1
3
20
12
21

SAFETY DEVICE FOR FUSES

The invention pertains to a safety device which can be adapted to any type of fuse - whether it be mechanical, electrical or electronic - of the type comprising a mobile element which can be moved from a safety position to an active position, the movement of aforesaid mobile element being, if necessary, controlled by an appropriate delay mechanism.

Various devices of this type have already been suggested. They generally offer efficient but rather complex solutions to the problem of locking aforesaid mobile element in safety position and to that of the safety of bore and muzzle.

The main purpose of the present invention is to supply a simple solution to abovesaid problems, by only making use of a few parts which are relatively easy to manufacture and to assemble.

The invention more specifically tends to supply such a safety device which almost exclusively comprises bodies of revolution which are slidingly fitted within each other.

A further purpose of the invention is to permit the detection, by simple mechanical means, of the difference between the effect of an accidental drop or vibration due to transport (shocks) and a propulsion (acceleration) or breaking (deceleration) produced by ballistic firing.

These purposes have been attained, according to the invention, by a safety device for fuses, of the type under consideration, which provides the combination of a tubular bolt, which assures the locking of aforesaid mobile element in safety position; of a sheath which at least partially surrounds aforesaid bolt; of balls which are entered in radial passages provided for this purpose in aforesaid sheath; of a collar which surrounds aforesaid sheath at the level of aforesaid passages, this collar having the possibility of being moved axially by the effect of inertia so as to free aforesaid passages and to allow the expulsion of aforesaid balls; and of an elastic means which stresses aforesaid collar towards its closing position of aforesaid passages.

Figure 1:
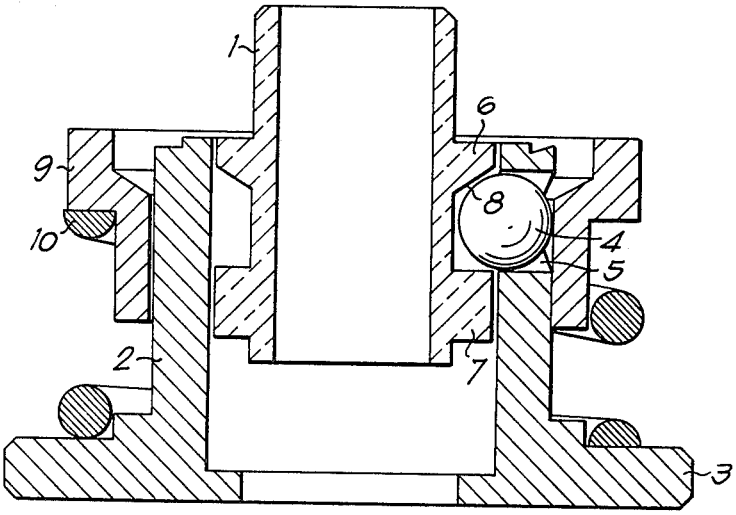
Figure 6:
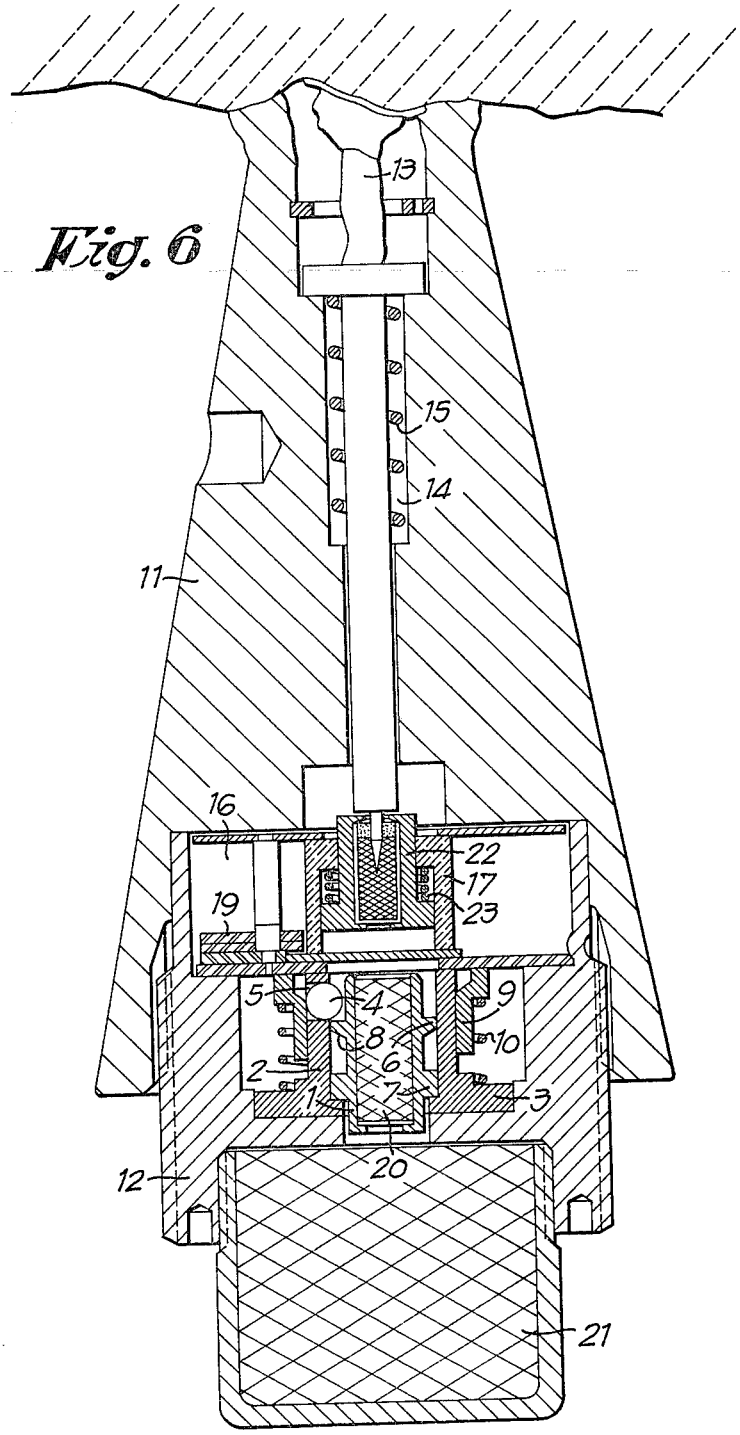

In view of greater clearness, an example of realization of the invention is described hereinafter as illustration and without the slightest restrictive purpose, with reference to the appended drawings in which:

FIG. 1 shows an axial section of a possible form of embodiment of the device according to the invention; and FIGS. 2 to 6 are axial sections of a fuse for projectiles from pieces of artillery, fitted with a device according to FIG. 1, shown in five characteristic positions, to wit: at rest (FIG. 2); in acceleration phase (FIG. 3); at the end of acceleration (FIG. 4); in flight (FIG. 5); and on impact (FIG. 6).

The device according to the invention mainly consists of a tubular bolt 1 which fits in a cylindrical sheath 2 which is provided with an annular base 3. Balls 4, preferably in uneven number and entered in radial passages 5 provided in sheath 2, normally maintain bolt 1 in the position of FIG. 1, or so-called high position.

The balls 4 are located between two peripheral protrusions 6 and 7 of aforesaid bolt, protrusion 6 having a slanting lower surface 8.

An axially mobile collar 9, which is stressed towards its upper position by a spring 10, surrounds sheath 2. In this upper position it maintains the balls in their cavities 5.

It will be noted that this device consists mainly of parts of revolution (1, 2 and 9) and that it forms a compact constructive unit.

The use of this constructive unit in a fuse for artillery projectiles is shown in FIGS. 2 to 6.

The fuse shown in this case consists of a conical head 11 and of a connection body 12. A plunger 13 is fitted in an axial bore 14 of aforesaid head 11. This plunger 13 is stressed towards its upper position - as shown in the FIGS. - by a spring 15, the purpose for which being explained further on.

Head 11 and body 12 define a cavity 16 into which is fitted an angularly mobile element 17 containing a constituent part of the pyrotechnical chain, namely the detonator. This element 17 can be moved by the action of a clockwork mechanism, schematically shown as 19.

The safety device according to the invention is located in aforesaid cavity 16, under assembly 17-19.

The pyrotechnical chain of the fuse also comprises a relay charge 20 and an additional charge 21.

Figure 2:
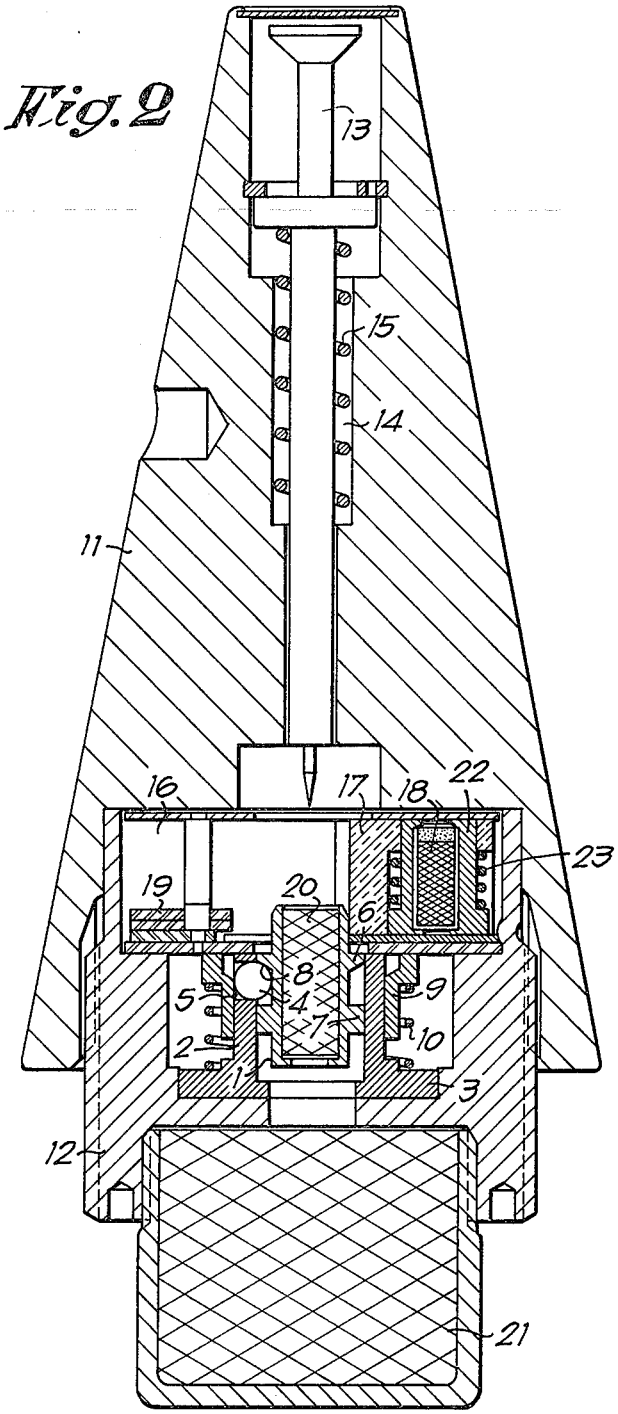
Figure 3:
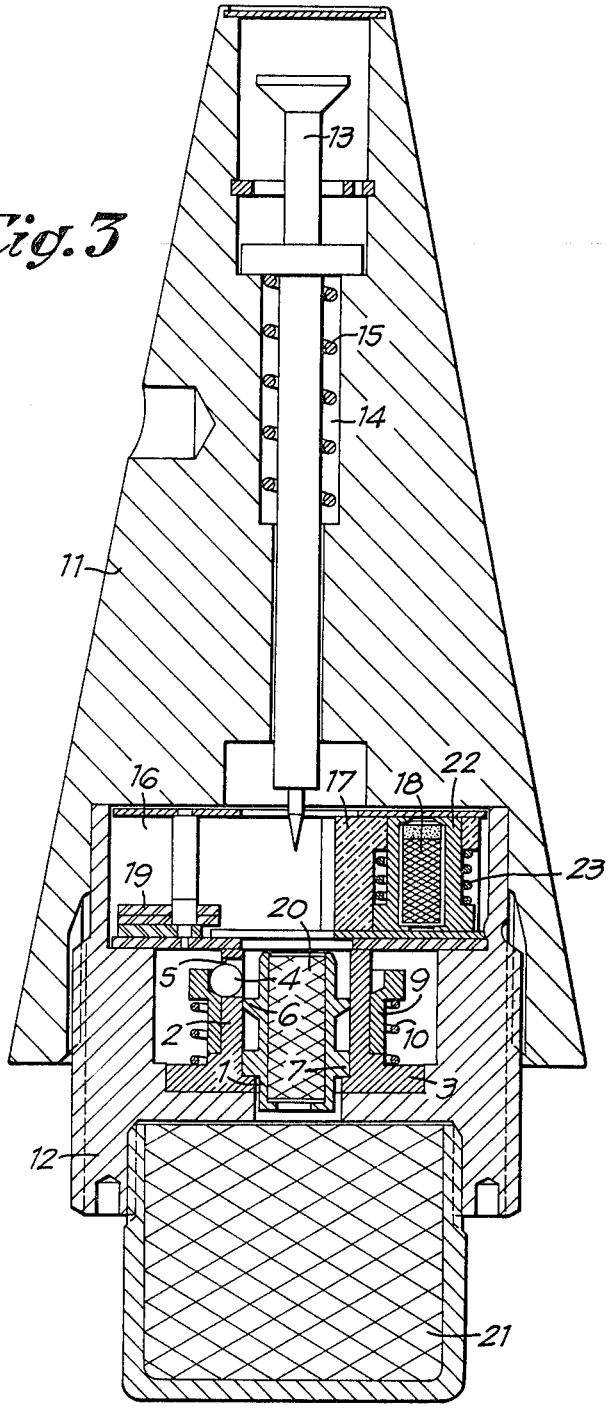
Figure 4:
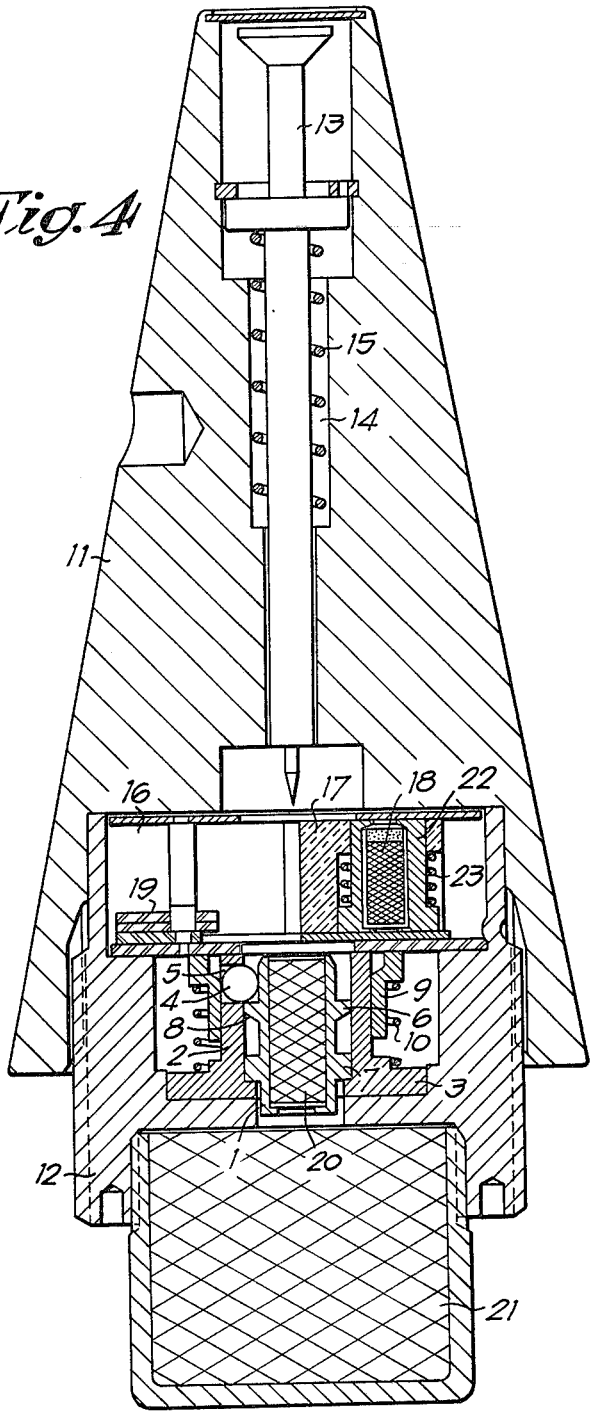
Figure 5:
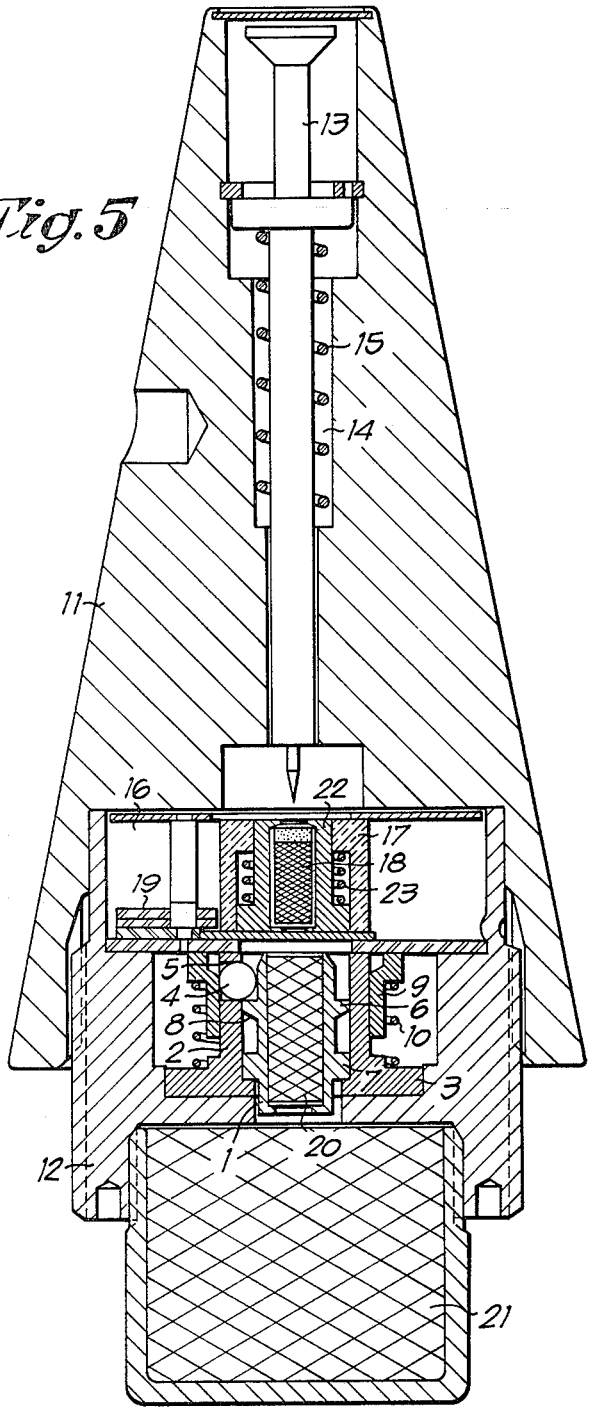

In the position illustrated by FIG. 2, bolt 1, blocked in its high position by balls 4, themselves blocked by collar 9, prevents any angular movement of mobile element 17. The pyrotechnical chain is thus interrupted, so that the fuse is in safety position.

In the hypothesis of a brutal shock, due for instance to the falling to the equipped ammunition to the ground, collar 9 might be moved down, thus liberating passages 5. However, the dimensions of collar 9 and the calibration of spring 10 are such that the balls would not have the time to escape, the kinetic energy stored in bolt 1 being spent before the freeing of passages 5, whereby, on the other hand, this freeing is of extremely short duration due to the rebounding of collar 9 on annular base 3 and to the action of spring 10.

During acceleration phase (FIG. 3), the bolt 1 totally enters sheath 2 and liberates mobile element 17. The force of inertia has however caused plunger 13 to recede, thus in opposition to spring 15; the point of plunger 13 now forms an impediament to the movement of mobile element 17 and in this manner constitutes a bore safety.

As soon as the forces on inertia on collar 9 and on plunger 13 are reduced, due to the diminishing acceleration, to values which are less than the forces of springs 10 and 15, collar 9 will return forward and press back balls 4, which thus lock element 1 by being located above protrusion 6. Simultaneously, plunger 13 returns to its advanced position, thus liberating mobile element 17, which then starts its rotating motion towards its active position, driven by clockwork mechanism 19 (FIG. 4), which may be driven in any suitable manner. This active position is reached during flight, as shown in FIG. 6.

On impact, and due to the upsetting (FIG. 6), the plunger 13 fires detonator 18, and consequently the entire pyrotechnical chain.

As shown in the drawings, detonator 18 may with advantage be fitted in a case 22, which is axially mobile within element 17 and is stressed downward by a spring 23. On impact therefore, this case 22 will be moved by inertia (FIG. 5), bringing the detonator 18 up towards plunger 13. This effect combines with the effect of upsetting of plunger 13.

It should be noted that the safety device described above is particularly simple and will operate with absolute reliability. Being made up solely of bodies of revolution encased in each other, its manufacture and its assembly are particularly easy.

It can be preassembled and tested before insertion in the ammunition. It will moreover operate just as well with rotating ammunition as with non rotating ammunition.

It is quite obvious that numerous alterations of details can be brought about to the example described above as illustration, without thereby going beyond the scope of the invention as defined in the appended claims. The tubular bolt might for instance be empty and located between the plunger and the detonator borne by the mobile element.

The bolt might also be part of some electric or electronic priming circuit. In this case, its rearward movement would be used for unlocking an electric contact, thus causing the activation of a priming circuit.

What I claim is:

1. Safety device for fuses, of the type which comprises a mobile element, which can be moved from a position of safety in which aforesaid mobile element may be part of the pyrotechnical chain, to obstruct or permit the passage of an element of the fuse towards its active position, characterized by the combining of a tubular bolt having a locking shoulder therearound, assuring the locking of aforesaid mobile element; of a sheath which at least partially surrounds aforesaid bolt, of balls entered in radial passages provided in aforesaid sheath to engage one side of said shoulder to lock said bolt in an inactive position; of a collar which can move axially by the effect of inertia and having an oblique guide surface movable past said passages and permit the expulsion of aforesaid balls and to project them along said surface to the other side of said shoulder to lock said bolt in its active position; and of an elastic means which stresses aforesaid collar towards the closing position of aforesaid passages.

2. Device according to claim 1, characterized by the fact that the tubular bolt guides an element of the pyrotechnical chain.

3. Device according to claim 1, characterized by the fact that aforesaid tubular bolt comprises two peripheral protrusions intended to engage the balls respectively in a position of safety and in an active position.

4. Device according to claim 1, characterized by the fact that aforesaid tubular bolt, sheath and collar are all bodies of revolution.

* * * * *